US010899168B2

(12) United States Patent
Madan

(10) Patent No.: US 10,899,168 B2
(45) Date of Patent: Jan. 26, 2021

(54) DEVICE FOR PROTECTING AND PRESERVING A SUBSTANCE IN A CONTAINER

(71) Applicant: Paul Madan, University Hts, OH (US)

(72) Inventor: Paul Madan, University Hts, OH (US)

( * ) Notice: Subject to any disclaimer, the term of this patent is extended or adjusted under 35 U.S.C. 154(b) by 156 days.

(21) Appl. No.: 15/988,077

(22) Filed: May 24, 2018

(65) Prior Publication Data

US 2018/0339548 A1 Nov. 29, 2018

Related U.S. Application Data

(60) Provisional application No. 62/510,967, filed on May 25, 2017.

(51) Int. Cl.

| | |
|---|---|
| ***B65D 3/12*** | (2006.01) |
| ***B65D 43/02*** | (2006.01) |
| ***B65D 43/08*** | (2006.01) |
| ***B65D 51/14*** | (2006.01) |
| ***B65D 81/24*** | (2006.01) |
| ***B44D 3/12*** | (2006.01) |
| *B65D 43/18* | (2006.01) |

(52) U.S. Cl.

CPC ..... *B44D 3/127* (2013.01); *B65D 43/0214* (2013.01); *B65D 81/245* (2013.01); *B65D 43/08* (2013.01); *B65D 43/18* (2013.01); *B65D 51/145* (2013.01); *B65D 2543/00037* (2013.01); *B65D 2543/0049* (2013.01); *B65D 2543/00092* (2013.01)

(58) Field of Classification Search

CPC ..... A47J 36/06; B44D 3/127; B65D 41/023; B65D 41/22; B65D 41/225; B65D 43/0214; B65D 43/08; B65D 43/18; B65D 51/145; B65D 51/2543; B65D 51/00037; B65D 51/00092; B65D 51/0049

USPC ..... 220/212, 212.5, 213, 216, 218, 227, 220/254.9, 287, 780, 789, 796, 801, 804

See application file for complete search history.

(56) References Cited

U.S. PATENT DOCUMENTS

| | | | | | |
|---|---|---|---|---|---|
| 1,025,090 | A * | 4/1912 | Holmes | B65D 41/22 | 220/287 |
| 1,129,115 | A * | 2/1915 | Nye | B65D 41/22 | 220/287 |
| 1,193,116 | A * | 8/1916 | Brusseau | B65D 41/22 | 220/287 |
| 1,322,863 | A * | 11/1919 | Bach et al. | B65D 41/22 | 220/287 |
| 2,167,619 | A * | 8/1939 | Bainton | B44D 3/12 | 220/578 |

(Continued)

FOREIGN PATENT DOCUMENTS

| | | | | |
|---|---|---|---|---|
| EP | 1247752 A1 * | 10/2002 | B65D 43/18 | |
| GB | 1046635 A * | 10/1966 | A45D 33/16 | |

*Primary Examiner* — Joshua E Rodden

(74) *Attorney, Agent, or Firm* — Rankin, Hill & Clark, LLP; Christopher Jan Korff

(57) ABSTRACT

Disclosed is a device for protecting and preserving a substance in a container. The device may include a plurality of overlapping sectors capable of rotating about a pivot point such that the device has a substantially disc shape when fully expanded and a substantially pie shape when partially expanded; and a lip defining an outer diameter of the device when fully expanded. The outer diameter of the device is equal to or greater than an inner diameter of the inner surface of the container.

14 Claims, 5 Drawing Sheets

(56) References Cited

U.S. PATENT DOCUMENTS 2,190,203 A * 2/1940 Barnard ..... A47J 47/04 220/578
2,453,274 A * 11/1948 Serowy ..... B44D 3/12 220/579
2,828,886 A * 4/1958 Thomas ..... B44D 3/12 220/579
3,120,902 A * 2/1964 Southworth ..... B65D 88/34 220/218
3,164,289 A * 1/1965 Cocchiarella ..... B65D 51/145 220/578
3,191,799 A * 6/1965 Figge ..... B44D 3/128 220/695
3,266,662 A * 8/1966 Palmer ..... B65D 51/02 220/579
3,380,624 A * 4/1968 Lincoln ..... B65D 51/18 220/578
3,987,941 A * 10/1976 Blessing ..... A47J 36/06 222/386
4,298,131 A * 11/1981 Saito ..... A47J 36/06 126/384.1
4,339,053 A * 7/1982 Tarro ..... B65D 17/4014 220/269
4,416,387 A * 11/1983 D'Antonio ..... B65D 81/245 220/579
4,625,886 A * 12/1986 Eisenman ..... B44D 3/00 215/231
4,682,705 A * 7/1987 Hurwitz ..... B44D 3/12 220/579
4,874,108 A * 10/1989 Valasek ..... B44D 3/12 220/578
4,934,558 A * 6/1990 Vargas ..... B65D 51/00 220/287
7,255,244 B2 * 8/2007 Miller ..... B44D 3/127 220/578
9,457,939 B1 * 10/2016 Peters ..... B65D 41/023
2004/0226955 A1 * 11/2004 Frantz ..... B65D 81/245 220/578
2014/0034650 A1 * 2/2014 Thomaschewski ... A47J 27/002 220/573.1
2014/0091090 A1 * 4/2014 Thaller ..... A47J 36/06 220/212.5

* cited by examiner

DEVICE FOR PROTECTING AND PRESERVING A SUBSTANCE IN A CONTAINER

CROSS-REFERENCE TO RELATED APPLICATION

This application claims the benefit of U.S. Provisional Application No. 62/510,967, filed May 25, 2017, the contents of which are incorporated herein by reference in their entirety.

FIELD

The present disclosure relates to a device for protecting and preserving a substance in a container. In particular, the present disclosure relates to a device for protecting a liquid in a vessel from falling debris and for minimizing evaporation and skinning of the liquid while the liquid is stored in the vessel.

BACKGROUND

Paints are typically housed in cylindrical metal containers or cans. The cans may be one of a range of sizes. The most common size in the U.S. is a 1 gallon pail. The can typically includes a sealable top lid that fits tightly, when properly closed, into a rim of the can such that the lid prevents the paint from drying or forming a skin when the can is full or nearly full. However, as the contents of the can are used over time, the ratio of paint to residual air in the can may decrease substantially. This residual air is responsible for allowing the paint to partially evaporate, dry out, or form a thick skin on top ("skinning"). For typical consumers, the paint may be stored in cans for many years.

In addition to drying and skinning, another problem that is especially common with water-based (i.e., "latex") paint is that the wall of the can and the rim may rust where exposed to water vapor in the air cavity above the paint. When the rust falls into the paint, the color of the paint may be affected. Although known paint covering devices may help prevent increased water vapor content in the air, they do not eliminate humidity already present in the air. Therefore, rusting inside a partly used paint can is a common problem, especially for the rim, which is usually made of steel even when the remainder of the can is plastic. This problem may be exacerbated when the rim is coated with paint during use before storage.

Known paint covering devices are typically inserted into the can above the new level of paint as paint is removed from the can. Thus, the paint is protected from the residual air in the can with the objective of reducing evaporation and skinning. However, these devices typically fail to address the rust problem. They are not designed to intercept falling debris, e.g. rust, to prevent it from falling into the paint. Furthermore, if a covering device scrapes the sides or rim when it is inserted into, or removed from, the can, the device may scrape any rust present and cause it to fall into the paint. This is especially common when, as is typical, the rim has a smaller inner diameter than the inner diameter of the wall of the can. Devices that must be deformed into a shape small enough to pass through the smaller inner diameter of the rim may be especially problematic. For instance, such devices may be especially liable to scrape the side of the can when inserting them into the can.

Thus, a need exists for a paint can shield for use in a can to protect the paint by preventing rust from falling into the paint. Additionally, a paint can shield may reduce evaporation and skinning of the paint while the paint is stored in a partially used can.

SUMMARY

According to one aspect, a device for protecting and preserving a substance in a container includes a plurality of overlapping sectors capable of rotating about a pivot point such that the device has a substantially disc shape when fully expanded and a substantially pie shape when partially expanded; and a lip defining an outer diameter of the device when fully expanded. The container may have a circular base and cylindrical wall extending upwardly from the base, and the wall may include an inner surface having an inner diameter. The outer diameter of the device is equal to or greater than the inner diameter of the inner surface.

According to another aspect, a method of using a device for protecting and preserving a substance in a container includes rotating a plurality of overlapping sectors of the device about a pivot point such that the device at least partially collapses; inserting the at least partially collapsed device into the container without the device making contact with the cylindrical wall of the container; and rotating the plurality of overlapping sectors such that a lip of the plurality of overlapping sectors engages the cylindrical wall along the internal circumference.

DETAILED DESCRIPTION

Figure 1A:
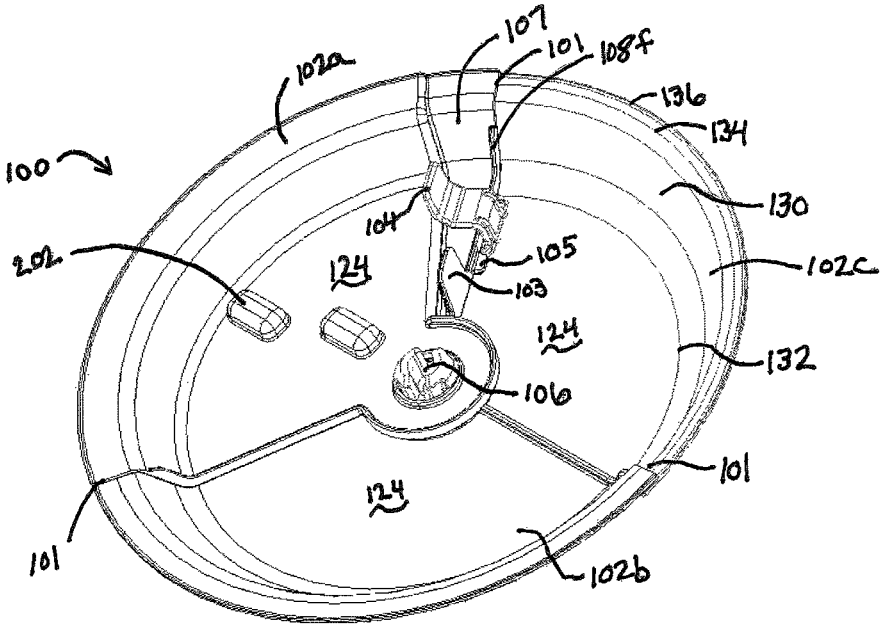
FIG. 1A shows an embodiment of the shield in a fully expanded configuration.

Unless defined otherwise, all technical and scientific terms used herein have the same meaning as commonly understood by one of ordinary skill in the art. Although any methods and materials similar or equivalent to those described herein can be used in the practice or testing of the disclosed embodiments, certain methods and materials are now described.

Although the following disclosure relates to protection of paint in containers, the invention is explicitly not so limited. One of ordinary skill in the art will recognize that the following description may also apply to protection of other fluids and/or solids within an enclosed circular container or can, as well as other protective fluids and coatings (i.e., varnish and/or lacquer).

The following description refers to a "paint can shield" or a "fluid cover" or a "paint cover" or a "shield." These terms are synonymous and no distinction is drawn between them. Described is a device that is placed above some liquid in a vessel after the vessel has been opened and some of the liquid has been removed so as to lessen the amount of liquid in the vessel. Thus, the device may protect the liquid in the vessel from debris falling into it from various sources, e.g. particulates in the air, dust, and rust originating from the vessel itself. Additionally, the relative volume of air in the vessel may be maintained after removal of the liquid by lowering of the device as the liquid is removed.

Referring now to the Figures, vessel 110 may include base 112 and wall 114 extending upward from the base 112. The wall 114 may terminate at rim 116, which is configured to receive the lip of a cover lid (not shown). Handle 118 may assist with the transport of the vessel 110. The shield 100 may be located above liquid 120.

The shield 100 may have at least two, and perhaps even three or more, overlapping sectors 102*a*, 102*b*, and 102*c* that rotate on central pivot point 106. Thus, the shield 100 may either collapse into an arcuate shape (i.e., substantially pie-shaped) or expand into a complete circular shape (i.e., substantially disc-shaped). When expanded, a lip 136 at the perimeter of the shield 100 may have an outer diameter that is greater than or equal to an inner diameter of wall 114 of vessel 110. When collapsed, shield 100 may pass through vessel rim 116 without making contact with rim 116 such that the shield will not scrape rust off the vessel rim 116 or wall 114, for example. When fully expanded, shield 100 may closely fit inside wall 114, due to contact between the entire circumference of the shield 100 with the inside wall 114 as the shield 100 is fully deployed, while being held at a level above the liquid 120 inside the can. In one embodiment, the shield 100 may be allowed to make contact with the top layer of the liquid 120, thereby preventing (or slowing) formation of a surface skin at that layer.

Disc sectors 102*a*, 102*b*, and 102*c* may be sector-shaped portions of the shield 100, which is circular-shaped when expanded. The sectors 102*a*, 102*b*, and 102*c* may be bound by radial edges 101 and lip 136. Each sector 102*a*, 102*b*, and 102*c* may include base 124 connected by an arcuate (or annular) sidewall 130 to arcuate (or annular) lip 136. Pivot point 106 is formed at a radial central axis, and the two radial edges form leading and trailing edges, named according to their function when the pivotingly joined sectors 102*a*, 102*b*, and 102*c* of shield 100 are rotated toward the expanded position. The sector arc lengths may be sufficient to cause overlapping and/or abutting of radial edges 101 when the shield is expanded, thereby forming the full circular disc, as well as providing substantially no gaps and/or holes through the expanded shield 100.

Shield sidewall 130 may have a profile that provides flexibility for constricting the diameter of the shield 100 under pressure from the vessel wall 114 as the shield 100 is expanded. Sidewall 130 may extend upwardly from boundary 132 of generally flat center disc 124 to inside boundary 134 of annular lip 136. In addition, sidewall 130 may extend outward from boundary 132.

Figure 4A:
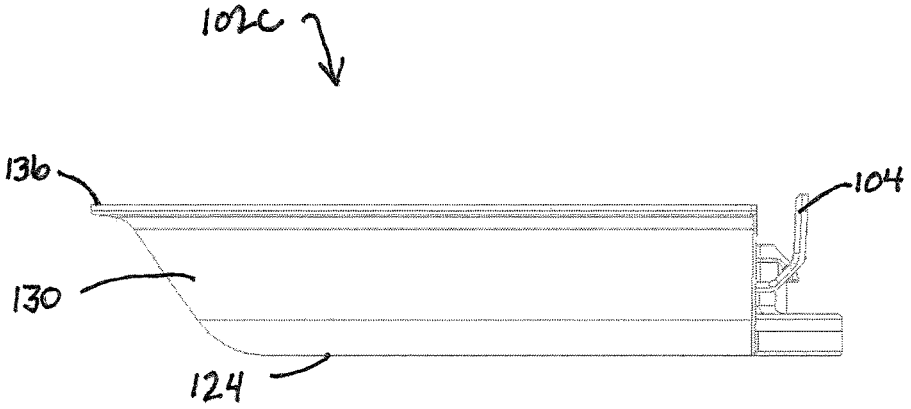
FIG. 4A is a profile view of a portion of the embodiment shown in FIG. 1A.
Figure 4B:
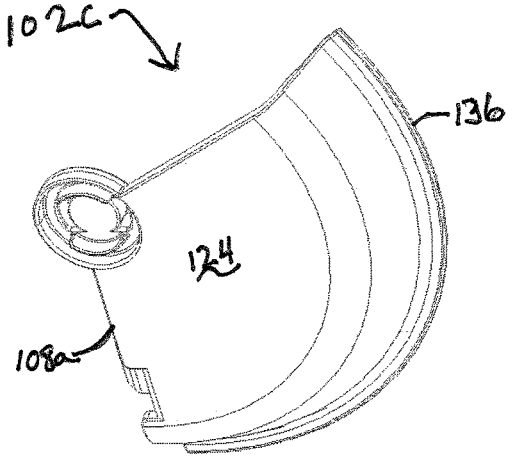
FIG. 4B is a bottom view of the portion shown in FIG. 4A.
Figure 4C:
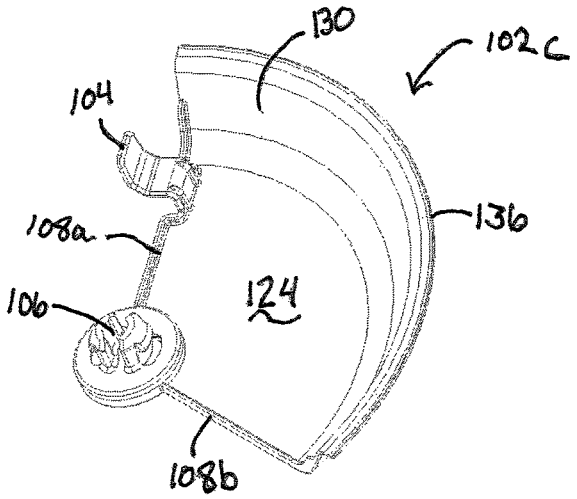
FIG. 4C is a top view of the portion shown in FIG. 4A.
Figure 5A:
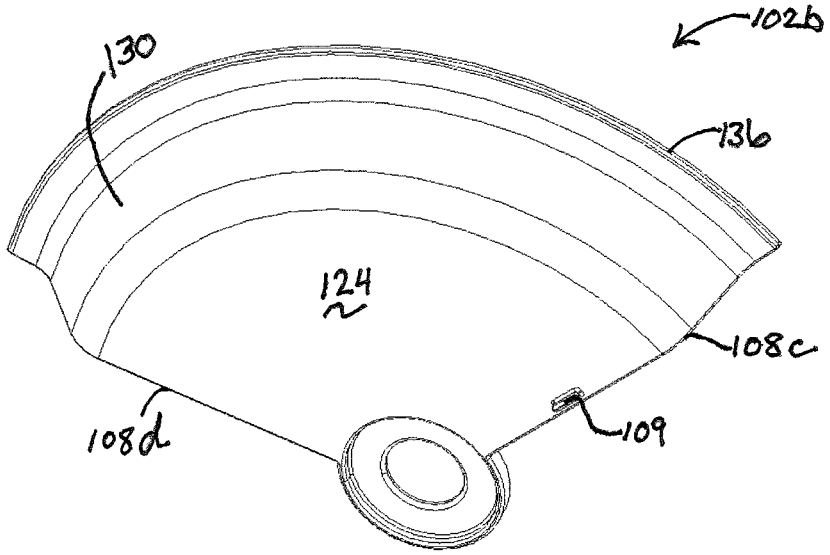
FIG. 5A is a bottom view of a portion of the embodiment shown in FIG. 1A.
Figure 5B:
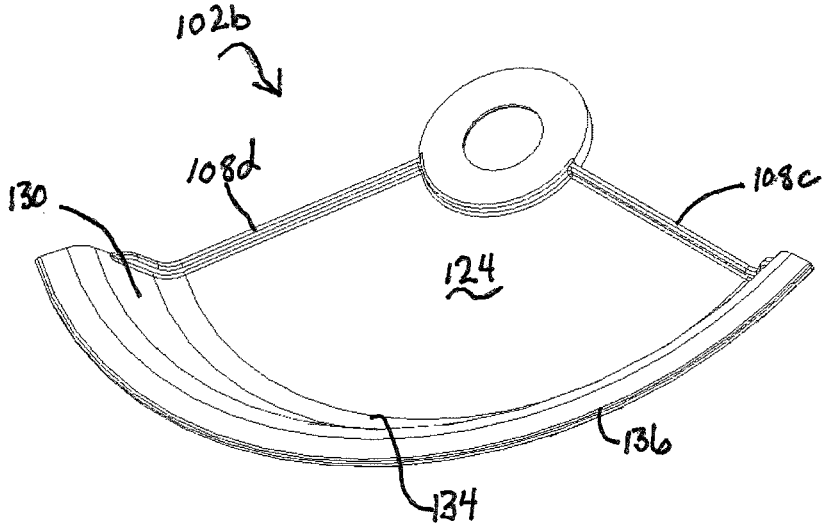
FIG. 5B is a bottom view of the portion shown in FIG. 5A.

Referring to FIG. 4, the profile of the disc sector 102*c* may be smoothly curved, as shown, but may also be not smoothly curved. FIG. 4 shows disc sector 102*c*, but the profile is equally applicable to sectors 102*a* and 102*b*. Any configuration is possible, so long as the base 124 is recessed below the lip 136. This arrangement allows cleaning rust from rim 116 and/or wall 114 before removing shield 100. In addition to the arcuate sidewall 130, raised ridges 108 at radial edges 101 and around pivot point 106 of sectors 102*a*, 102*b*, and 102*c* retain rust, even as the shield is collapsed and tilted to remove the shield 100 from the vessel 110. These ridges 108 may also retentively abut the bottom surface of an overlapping sector 102*a*, 102*b*, and 102*c*.

The profile should allow for some flexibility in the outer diameter of the lip 136 when under pressure from the vessel wall 114 as the shield 100 is expanded to help provide sealing contact between the lip 136 and the vessel wall 114. In addition, to further facilitate flexibility and sealing contact, the thickness and/or constituent material of the shield sidewall 130 and/or lip 136 may be tailored. For example, the shield sidewall 130 and/or lip 136 may be tapered to a thin or feathered outer edge.

Ridges 108*a-f* of radial edges 101 on one sector may abut rotation stops 109 on other sectors during expansion of the shield 100. This prevents over-rotation, which would open a gap between adjacent leading and trailing edges 101. In one embodiment, ridges 108*a-f* may be present on the leading edges and rotation stops 109 may be present on the trailing edges. In another embodiment, ridges 108*a-f* may be present on the trailing edges and rotation stops 109 may be present on the leading edges. In another embodiment, rotation stops 109 and ridges 108*a-f* may be distributed on a mixture of trailing edges and leading edges. In another embodiment, each trailing edge and each leading edge may include both a rotation stop 109 and a ridge 108*a-f*. In another embodiment, a portion of the total number of ridges 108*a-f* present on shield 100 are present on leading edges while the remainder of the total number of ridges 108*a-f* present on shield 100 are present on trailing edges. In the same or a different embodiment, all stops 109 may be present on the trailing edges. In one embodiment, ridges 108*a*, 108*c*, and 108*e* may exist on three different trailing edges, and ridges 108*b*, 108*d*, and 108*f* may exist on three different leading edges.

Figure 1B:
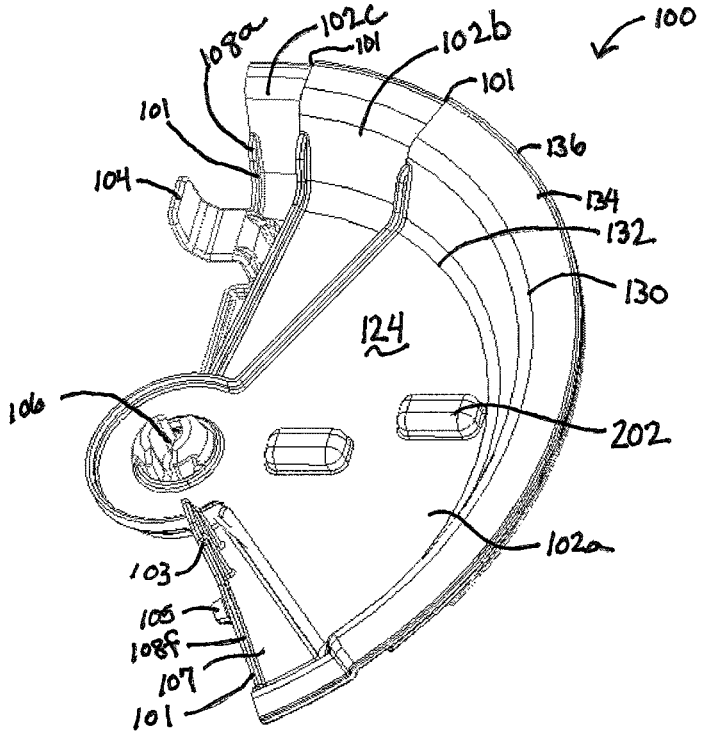
FIG. 1B shows an embodiment of the shield in a collapsed configuration.
Figure 2:
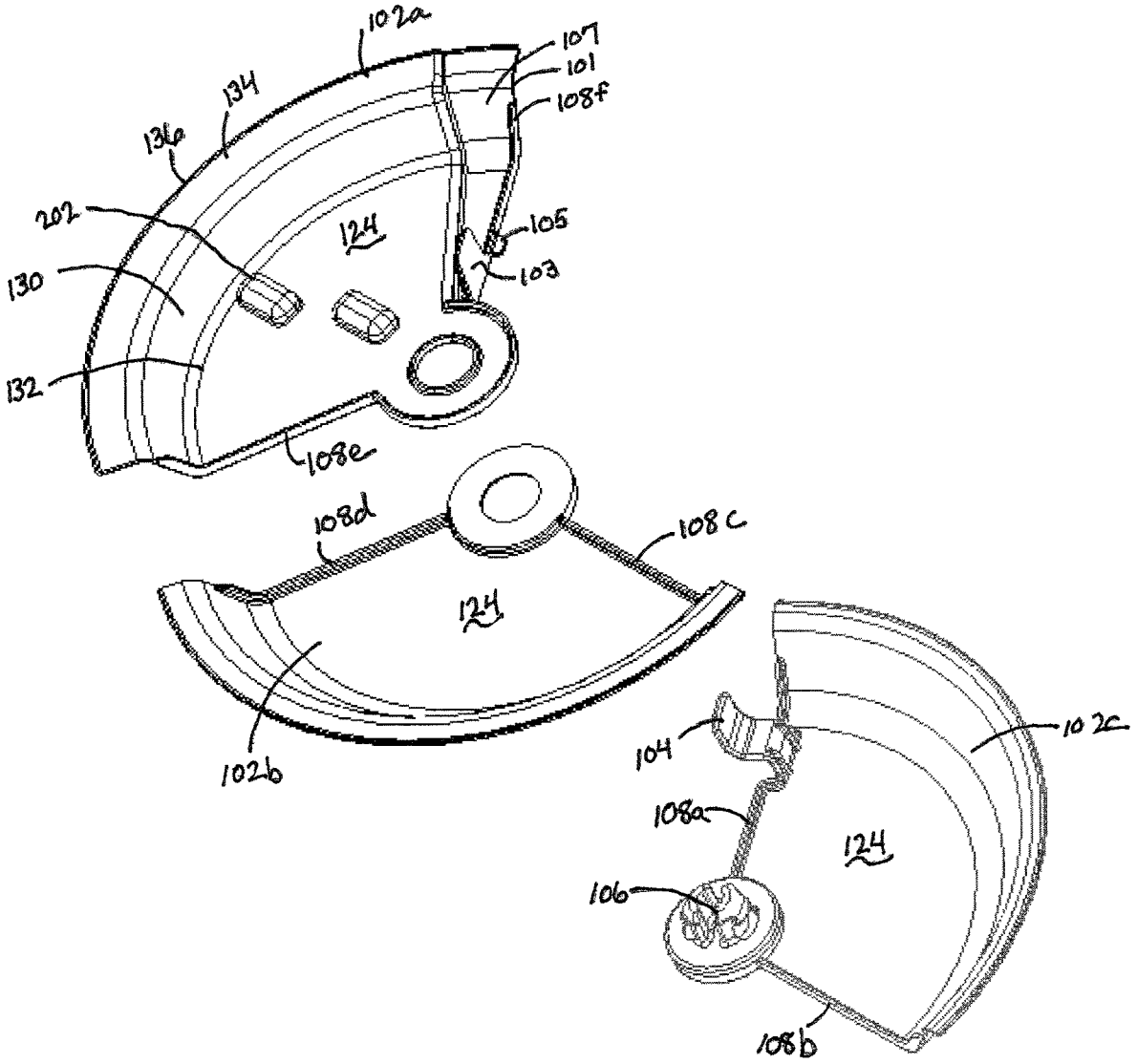
FIG. 2 is an exploded view of the embodiment shown in FIGS. 1A and 1B.
Figure 3:
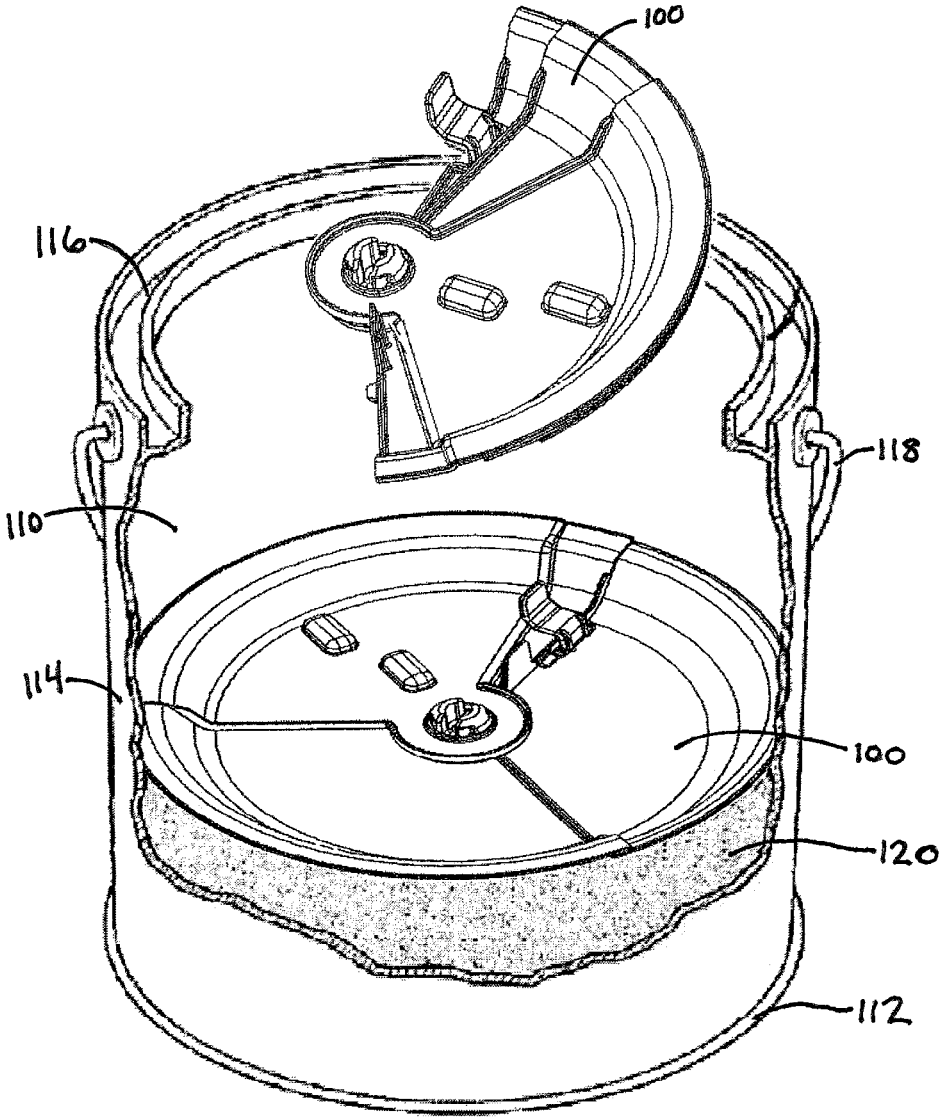
FIG. 3 shows the embodiment shown in FIGS. 1A and 1B as used with a paint can.

As best shown in FIG. 2, top sector 102*a* may include step-down portion 107 at the sector's leading edge, and this step-down portion 107 may overlap with the trailing edge of bottom sector 102*c*. Such an arrangement may help seal the abutment between the two sectors 102*a* and 102*c*. This arrangement also causes ridge 108*a* to be hidden under ridge 108*f* when the shield 100 is fully expanded, as is best shown in FIG. 1.

Various methods of securing top sector 102*a* to bottom sector 102*c* may be employed. As shown in FIG. 2, detent 105 and latching tab 104 may interact with corresponding ridges 108*a* and 108*f*, respectively, to hold the shield 100 in the expanded configuration. In one embodiment, latching tab 104 may extend upward and outward from the trailing edge of bottom sector 102*c* toward the leading edge of top sector 102*a* for pressing the detent 105 over ridge 108*a*.

One or both of finger grip 103 and latch tab 104 may be used to provide points of contact for the user's fingers when collapsing and expanding the shield 100. Thus, finger grip 103 and latching tab 104 may be squeezed together to complete deployment, forcing lip 136 to make contact with the vessel wall 114 around substantially the entire circumference of the lip 136, when the shield 100 is fully expanded. In addition, shield 100 may also include recesses 202 to nestingly receive finger grip 103 and latch tab 104 when a plurality of shields 100 are stacked together for storage, transport, and/or sale, as best shown in FIG. 2. Recesses 202 are formed by having a hollow nodule extend above the plane of disc 124 such that a pocket is formed through the plane of disc 124.

The present invention has been described herein with regard to certain embodiments. However, it will be obvious to persons skilled in the art that a number of variations and modifications can be made without departing from the scope of the invention as described herein.

What is claimed is:

1. A device for protecting and preserving a substance in a container, said device comprising:

at least three non-planar overlapping sectors capable of rotating about a pivot point such that the device has a substantially disc shape when fully expanded and a substantially pie shape when partially expanded;

wherein said at least three non-planar overlapping sectors provide substantially no gaps or holes through the fully expanded device; and a lip defining an outer diameter of the device when fully expanded;

wherein each of the at least three non-planar overlapping sectors comprises a sector base connected by a flexible arcuate or annular sidewall to the lip, wherein the device is configured to fit within an associated container to create a substantially airtight seal.

2. The device of claim 1, comprising three non-planar overlapping sectors.

3. The device of claim 1, wherein an out diameter of the device is configured to be equal to an inner diameter of an inner surface of the associated container.

4. The device of claim 1, wherein an outer diameter of the device is configured to be greater than an inner diameter of an inner surface of the associated container.

5. The device of claim 1, wherein the arcuate sidewall curves upward to the lip.

6. The device of claim 1, wherein the arcuate sidewall curves outward toward the lip.

7. The device of claim 1, wherein the sector base is recessed below the arcuate sidewall.

8. The device of claim 1, wherein the at least three non-planar overlapping sectors interact with one another so as to provide a substantially retentive abutment between adjacent overlapping sectors.

9. The device of claim 1, further comprising at least one finger grip.

10. The device of claim 1, further comprising a detent, a latching tab, and a finger grip, each of the detent, the latching tab, and the finger grip being on at least one, two, or three of the at least three overlapping sectors.

11. The device of claim 1, further comprising a finger grip on at least one of the at least three overlapping sectors.

12. The device of claim 1, further comprising a step-down portion on at least one of the at least three overlapping sectors.

13. The device of claim 1, wherein each of the at least three overlapping sectors comprises a leading edge and a trailing edge, and said leading edge includes a ridge, said trailing edge includes a rotation stop, and the trailing edge includes a ridge.

14. A device for protecting and preserving a substance in a container, said device comprising:

(a) a plurality of overlapping sectors capable of rotating about a pivot point such that the device has a substantially disc shape when fully expanded and a substantially pie shape when partially expanded;

wherein at least one, two, or three of the plurality of overlapping sectors further comprises a detent, a latching tab, and a finger grip; and (b) a lip defining an outer diameter of the device when fully expanded;

wherein the device is configured to fit within an associated container to create a substantially airtight seal.

* * * * *